United States Patent [19]

Ries et al.

[11] 4,315,816

[45] Feb. 16, 1982

[54] HIGH INTENSITY MAGNETIC FIELD DRUM SEPARATOR

[75] Inventors: Guenter Ries; Klaus-Peter Jüengst; Siegfried Föerster; Franz Graf, all of Karlsruhe; Wolfgang Lehmann, Leopoldshafen; Karl-Heinz Unkelbach; Gottfried Düeren, both of Cologne, all of Fed. Rep. of Germany

[73] Assignee: Klöckner-Humboldt-Deutz AG, Fed. Rep. of Germany

[21] Appl. No.: 843,738

[22] Filed: Oct. 19, 1977

[30] Foreign Application Priority Data

Nov. 4, 1976 [DE] Fed. Rep. of Germany ..... 2650540

[51] Int. Cl.[3] ..... B03C 1/14

[52] U.S. Cl. ..... 209/223 A

[58] Field of Search ..... 209/11, 223 R, 219, 209/223 A; 335/216; 210/222, 223

[56] References Cited

U.S. PATENT DOCUMENTS

| | | | |
|---|---|---|---|
| 1,371,301 | 3/1921 | Converse | 209/219 |
| 2,992,738 | 7/1961 | Maynard | 209/223 R |
| 3,433,892 | 3/1969 | Bindari | 335/216 X |
| 3,480,895 | 11/1969 | Albrecht | 335/216 X |
| 3,489,280 | 1/1970 | Israelson | 210/222 X |
| 3,503,504 | 3/1970 | Bannister | 209/223 R |
| 3,842,751 | 10/1974 | Thornton | 335/216 X |
| 3,900,809 | 8/1975 | Kullmann | 335/216 |

FOREIGN PATENT DOCUMENTS

| | | | |
|---|---|---|---|
| 27102 | 6/1930 | Australia | 209/219 |
| 845331 | 6/1952 | Fed. Rep. of Germany | 209/223 R |
| 426705 | 7/1972 | U.S.S.R. | 209/223 R |

*Primary Examiner*—Robert Halper

*Attorney, Agent, or Firm*—Hill, Van Santen, Steadman, Chiara & Simpson

[57] ABSTRACT

An arcuate shaped magnetic system is housed in a fixed cryostat within a rotating drum. A slurry containing magnetizable particles is charged into an operating area defined by the magnetic system at the lower part of the drum and magnetic particles adhering to the drum are removed as the drum rotates the same to a discharge location. The cryostat has an outer wall which conforms to the shape of the drum and houses a sector-shaped refrigeration tank. The refrigeration tank has an arcuate wall section conforming to the shapes of the cryostat wall and the drum and is positioned in close proximity to the outer cryostat wall only in the operating area in order to minimize inward heat transfer.

6 Claims, 5 Drawing Figures

HIGH INTENSITY MAGNETIC FIELD DRUM SEPARATOR

BACKGROUND OF THE INVENTION

1. Field of the Invention

This invention relates to a high intensity magnetic field drum separator having an open magnetic system fixedly arranged within the interior of the drum.

2. Description of the Prior Art

It is usual, with magnetic separators, to differentiate between low intensity magnetic field separators and high intensity magnetic field separators, respectively, which are installed for different types of problems or objectives.

Low intensity magnetic field separators are, as a rule, constructed as drum separators having open magnetic systems, and are predominantly installed for the sorting preparation of strongly magnetic material, or at least magnetic materials having a medium susceptibility, while high intensity magnetic field separators, as a rule, have closed magnetic systems, and are primarily utilized for the preparation of weakly magnetic substances.

High intensity separators are, however, also known which do not differ in the sorting operation substantially from low intensity drum separators. In the case of both systems, a stationary magnetic system is arranged within the interior of a rotating drum.

In contrast, however, with the low intensity separators, in which the entire width of the drum is pentrated or permeated by the magnetic field, in the case of the known high intensity magnetic field drum separators, the magnets are so arranged that the magnetic field is limited to particular zones. Each pair of poles of the magnets which terminate directly on the same within the drum wall form a high intensity magnetic field. In order to draw the lines of force more strongly to the outside, annularly-shaped ferromagnetic outer poles are arranged on the outer periphery of the drum.

With a small scanning mask at the spacing of these outer poles or terminals, great magnetic forces can be attained. The price for this favorable condition is, however, a smaller effective area because of a smaller range, that is, in the end effect a very small preparation capacity, in that, with such high intensity magnetic field separators, the charging of the material to be separated must take place in grooves which convey the material between the outer poles. Magnetizable material adheres to the outer poles, and therebetween to the drum, and afterward is carried, through rotation, out of the area of the magnetic field, released, washed off or stripped off.

Because of the half-open magnetic field between the annularly-shaped poles, in the case of a high intensity magnetic field drum separator, the effective field strength is not as great as with similar separators, so called roller separators, whose operative field is arranged in the closed magnetic system, that is, between two magnetic poles applied to the rotatable drum from the exterior, with an intermediate air gap.

In known high intensity magnetic field drum separators, for example, the field strength is approximately 0.8–1 T (thousand). On the other hand, however, the half-open magnetic field permits separation of coarse grains, for example above 5 mm. Because of the free accessibility of the precipitation wall, the separator is, in addition, uncomplicated in technical operation, sturdy, and permits most easily of being adapted to special requirements, which result in each case through type and grain size of the charging material for a specific case of preparation, particularly in the case of wet magnetic preparation. In this respect, this high intensity magnetic field drum separator is superior to the high intensity magnetic field roller separator.

However, in addition to the previously mentioned low capacity, a further particular disadvantage arises in the known high intensity magnetic field drum separator, in that it has developed that the drum separator is not to be used for the separation of ores having grain sizes of, at least in part, far below 100 μm, which has recently become more and more important.

SUMMARY OF THE INVENTION

The object of the present invention, therefore, is to provide a simple type of separator of appreciably greater power and range, which permits separating also very weakly magnetic materials and materials advantageously finely divided in a carrier medium, while at the same time preventing the disadvantages of the known high intensity magnetic field drum separators, along with an economically justifiable cost. An attendant object is to obtain a high yield of separated material over a great range of grain sizes. Also, the free accessibility of the precipitation wall is to remain, that is, an open magnetic system is to be made the basis of the technical concept.

The above object is achieved and the aforementioned problems are resolved through the utilization of a magnetic system which comprises an arrangement of superconducting conductors.

In a particular development of the invention, it is provided that the magnetic system comprises at least one superconducting coil.

In the case of an advantageous arrangement constructed in accordance with the invention, it is further provided that the magnetic system comprise a plurality of superconducting coils and that the coils are embedded in the surface of a coil support which is composed of weakly magnetic iron which is adapted to the curvature of the magnetic drum.

For a functionally optimum configuration of the coils of the magnetic system, it is further provided that the perpendicular axes about which the coils are wound extend in the radial direction of the drum.

In order to obtain a uniform distribution of the magnetic forces in the operative field of the separator, it is of particular advantage that the coils have approximately the form of elongate ellipses, whose longitudinal axes are oriented, advantageously, parallel to the axis of rotation of the magnetic drum.

With such a coil structure, a spatially relatively large field-producing winding results having a good range and somewhat lower magnetic field gradients in relation to smaller winding dimensions. This is, however, not a disadvantage, but to the contrary, is of advantage for the operation of the separator, as it has been found that with sufficiently intensive, extremely high magnetic field intensity for the preparation operation of the separator, the range is at least just as important as the size of the magnetic force.

For the optimum development of the magnetic field, or for the optimizing of the range, it is further suitable that the coils are curved in the direction of the smaller axis of the ellipse in an adaptation thereof to the form of the drum.

Furthermore, it has been found advantageous that the adjacently disposed coils are energized in series.

Hereby a homogenizing is advantageously attained, to as great an extent as possible, of the power distribution over the range of operation of the magnetic separator, referred to equal radial distances from the center point M of the system through a relatively simple structural form and arrangement of the coils.

Furthermore, a suitable construction of the separator according to the present invention is characterized in that the length ratio of the axes of the coils from their inner positions (a/b) decreases toward their outer positions (a'/b'), where a is the minor axis of the innermost coil, b is the major axis of the innermost coil, a' is the minor axis of the outermost coil, and b' is the major axis of the outermost coil.

This development of the winding has a particular importance in that, upon maximizing of the field in the reverse area of the conductor, the so-called winding head, the extent of the winding heads helps to prevent an impermissible field magnitude.

With reference to the favorable concept of the open magnetic system, furthermore, the distance of the magnetic system from the outer side of the drum in the operating area of the separator should be utilized as little as possible for the optimum utilization of the magnetic force and range extent. On the other hand, a great spacing is a goal in order to hold the inward heat transfer of the material and the drum sleeve into the cryostat as low as possible.

The solution of this problem is optimally attained, according to the invention, in that the spacing of the refrigerating tank (containing the coils) from the drum wall in the operating area of the drum separator is as small as possible, while the spacing outside of the operating area is substantially greater.

In order to attain the spacing relationships, the refrigerating tank is constructed approximately sector-shaped in cross-section, in relation to the circularly-shaped cross-section of the drum.

An advantageous arrangement of the separator, according to the invention, also results in that the outer wall of the cryostat which receives the stationary refrigerating tank with the coil arrangement therein is also constructed as a drum having a circularly-shaped cross-section.

In this manner, according to the invention, the outer wall of the cryostat may be held rotatable and disclose the drum of the magnetic separator.

Magnetic systems are already knwon in the art which are equipped with superconducting coils, as disclosed in the German published application No. 24 28 273. In contrast to the present invention, the separator is not a drum separator and is not concerned with open magnetic systems. In this publication, which likewise illustrates the state of the art in the case of magnetic separators equipped with superconducting coils, it is determined that high intensity magnetic field separators of the previous type of construction possess closed magnetic systems.

Known separators of this type have the particular disadvantage in the lack of accessibility of the separating surface and, partially occasioned thereby, the low output appreciably hinders the practical installation of this category of high intensity magnetic field separators having closed magnetic systems.

To the contrary, the high intensity magnetic field drum separator, according to the present invention, combines the technical preparatory advantages of the known weak intensity drum separator with the high magnetic forces and the great range of a super conductive magnetic system.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
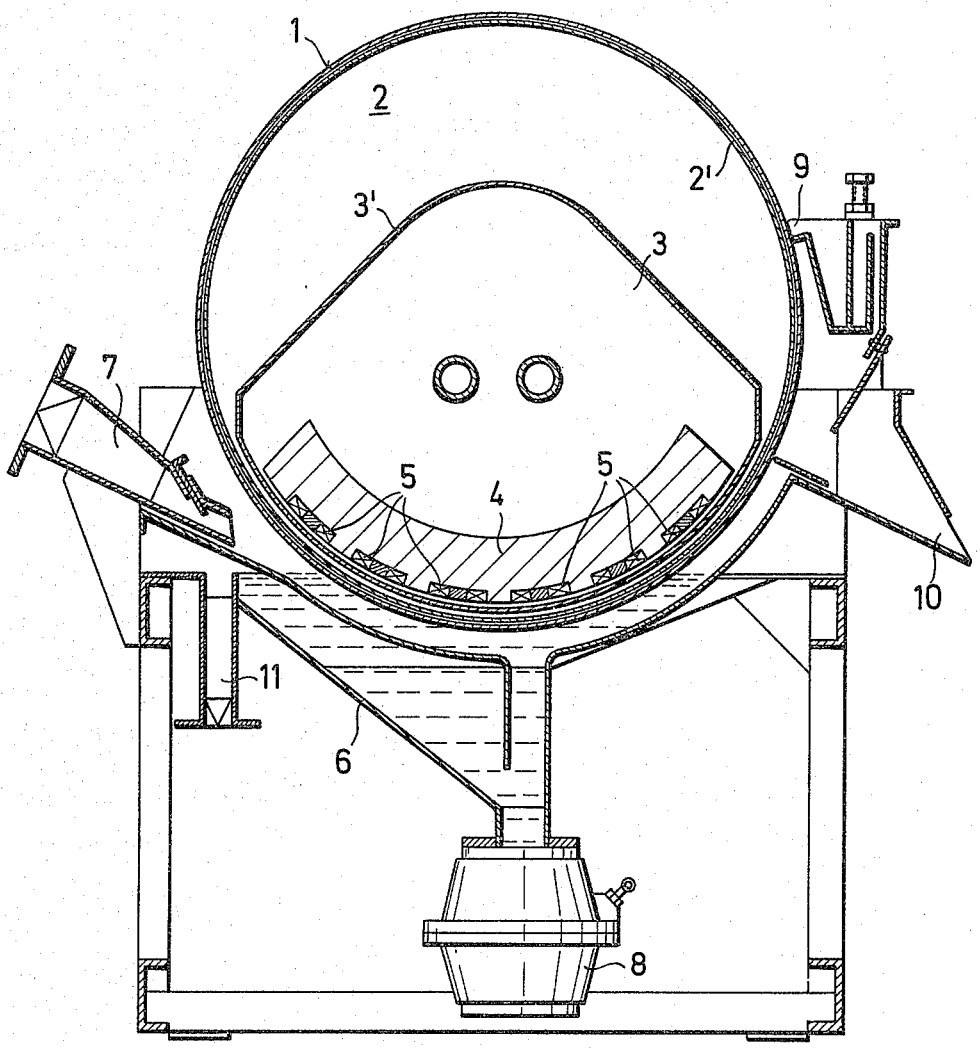
FIG. 1 is a sectional view through a magnetic separator, taken perpendicularly to the axis of rotation of the drum.

Referring to FIG. 1, a rotatable drum 1 of a magnetic separator is illustrated as having a cryostat 2 arranged therein, the cryostat 2 comprising an outer tank 2' and a refrigeration tank 3, in the present case a helium tank 3, fixedly arranged within the outer tank 2' of the cryostat. A plurality of superconducting coils 5 are arranged within the interior of the helium tank 3, and are held at a temperature of approximately 4° K. The coils 5 are received and mounted in grooves 15 in a solid, weakly magnetic iron block 4, which is adapted in its contour to the curvature of the helium tank 3 and therewith to the curvature of the drum 1. The block 4, constructed of weakly magnetic iron, is of importance for the coil arrangement for the reason that the individual parallel magnetic coils 5 wound in the same direction are repelled with appreciable forces. With the coils 5 arranged in an arcuate, rather than a planar, relationship, radially outwardly forces occur. Therefore, care must be taken for a corresponding compensation of these radial forces. A fixation of the coils 5 by mechanical means, however, would increase, in an impermissible manner, the spacing between the magnets and the slurry. This disadvantage is prevented in that the coil carrier 4 comprises weakly magnetic iron, whereby the coils 5, according to the principle of the magnetic level, are drawn toward the iron of the carrier or support 4. In this manner, the outwardly acting radial forces are compensated. Therefore, an interception of the coils by mechanical means may be omitted, and the same may be placed as near as possible to the slurry.

As to the concept of the horizontally disposed cryostat 2, the following will be of interest.

On the one hand, the object is to maintain as low as possible an inward heat transfer through the wall of the cryostat 2 from the hot part of the magnetic separtor, namely in the helium tank 3 and the coil arrangement 5. Between these two temperature zones, there always prevails a difference of approximately 300° K. This would mean that the distance of spacing between the walls of the drum 1, existing at room temperature, and the walls cooled to helium temperature, is to be selected as large as possible, particularly also in order to obtain sufficient space or room for the heat insulation.

In addition to this, the space between the outer tank 2' and the helium tank 3 is completely evacuated, in order to eliminate, to as great an extent as possible, heat transfer through convection. Furthermore, the oppositely lying walls in different heating zones are metallized or applied with a reflecting coating in order to thereby suppress, as far as possible, the heat radiation.

On the other hand, the distance between the magnetic system and the separation material is to be decreased to the least degree, in order to be able to optimally utilize the magnetic forces and the range of the magnetic field.

For this reason, the magnetic separator illustrated in FIG. 1, and constructed in accordance with the invention, possesses a drum-shaped cryostat 2, whose helium tank 3 is so shaped and arranged, that in the range or area of the magnetic coils 5, that is over about one-third of the periphery, the spacing between the parts of the separator which are at room temperature and at helium temperature, respectively, is minimized, whereby in this area higher heat losses are expected. In the remaining area, to the contrary, the helium tank 3 is drawn inwardly to form a sector shape, so that its rear wall 3' extends with appreciable spacing from the outer wall 2' of the cryostat, and because of this only a very low inflow of heat occurs.

The separator further comprises, according to the invention, structure which is similar to the primary members of known low intensity magnetic field drum separators, as illustrated in FIG. 1, and comprises a slurry tank 6, a regulatable slurry charging apparatus 7, a regulatable discharge member for nonmagnetic material 8, a stripper 9 for the magnetic material adhering to the drum, a discharge outlet 10 for the magnetic concentrate, and an overflow 11 on the slurry tank.

Figure 2:
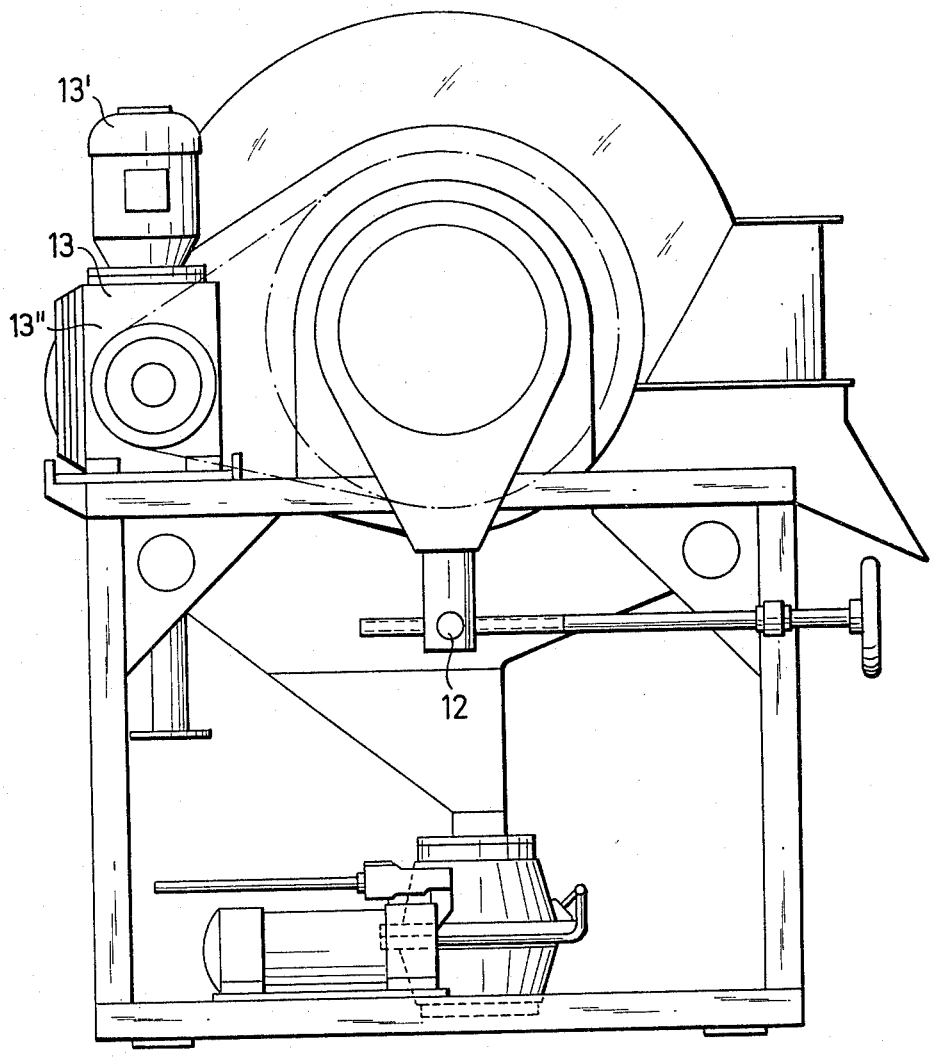
FIG. 2 is an elevational view of the same magnetic separator illustrated in FIG. 1.

FIG. 2 illustrates the separator from the same viewing angle as FIG. 1, however, in elevation. As seen in FIG. 2, an electro-mechanical driving block or headstock 13 is provided which includes a motor 13' and a gear unit 13''.

A spindle adjusting device 12 is provided, as is also provided in low intensity separators for positioning the magnetic system in the interior of the drum over the plane of the slurry level.

Figure 3:
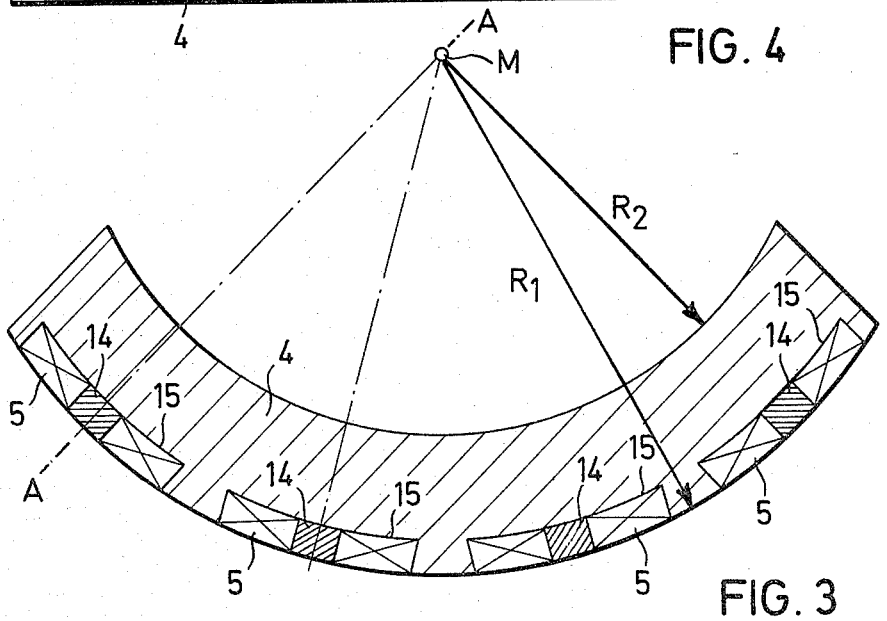
FIG. 3 illustrates the coil arrangement in the coil carrier constructed of weakly magnetic iron, shown in section.

FIG. 3 shows, in section, the weakly magnetic iron body 4 in the form of a segment of a cylinder having an outer radius $R_1$ and an inner radius $R_2$ which extend from a central point M. The body has a total of four grooves 15, which receive the four superconducting coils 5. In the center of each coil winding 5 is located a core 14, which is suitable made of the same material a the body 4. Furthermore, it is illustrated that the axis A—A, the perpendicular axis of the coil winding, extends radially through the center point M of the system, and therewith in the radial direction of the drum.

Figure 4:
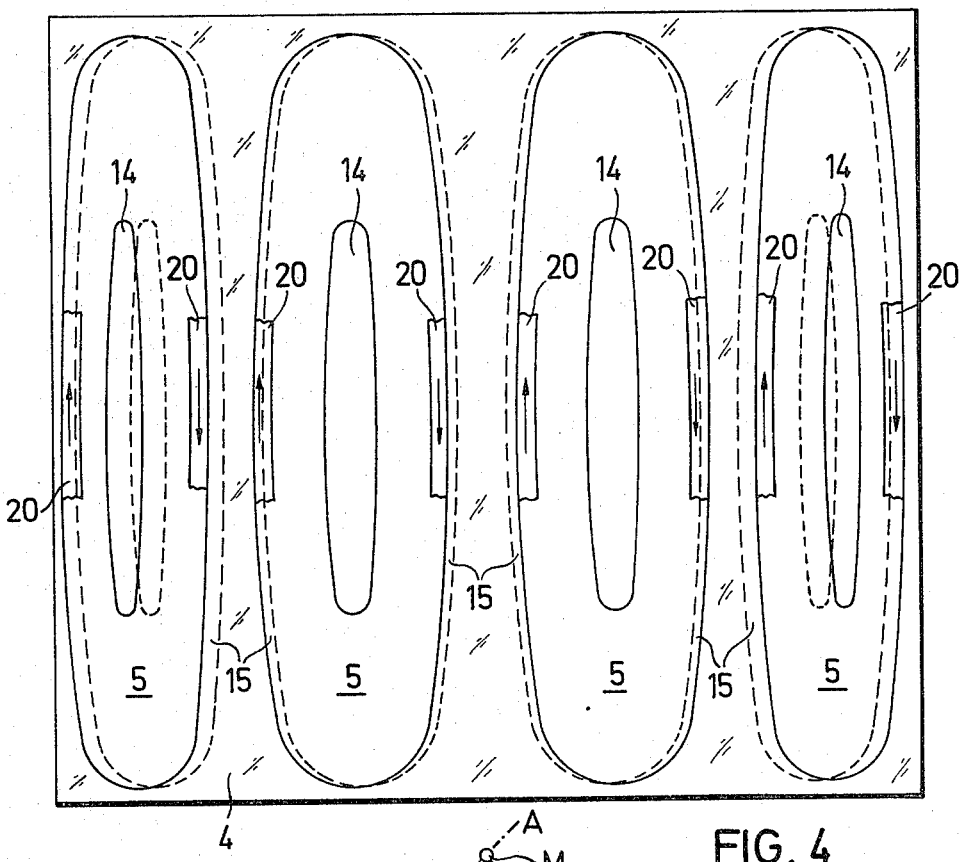
FIG. 4 is a generally planar view of the coil arrangement as seem from the coil side of the carrier.

FIG. 4 is a plan view of the coil and support arrangement of FIG. 3. It can be seen that the superconducting coils 5 are received in the grooves 15, and have therein the cores 14.

The purely diagrammatic illustration of individual windings 20 with the direction arrows of current flow illustrate that the parallel-arranged superconducting coils 5 are energized in the same direction.

Figure 5:
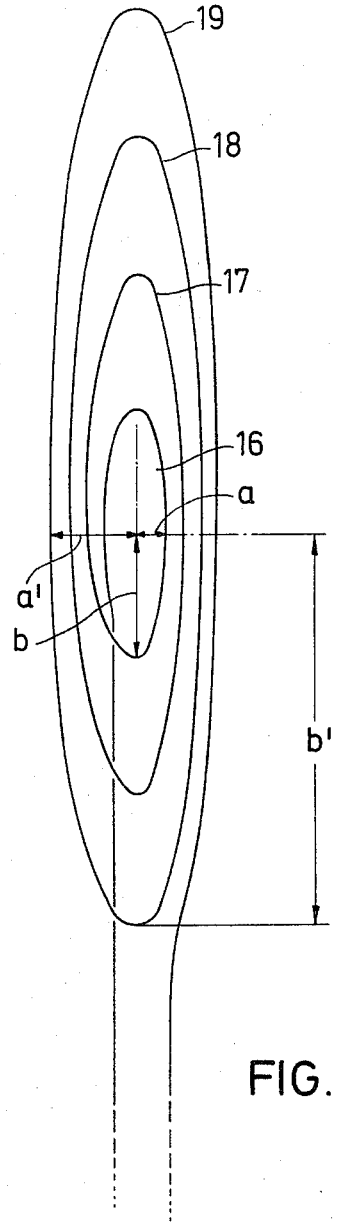
FIG. 5 is a diagrammatic illustration of the coil winding which may be employed in practicing the present invention.

FIG. 5 shows the winding configuration of an individual coil. It can be seen that the winding is in the form of an elongate shape, similar to an ellipse having a longitudinal axis b and a transverse axis a at the inner winding position, as well as a longitudinal axis b' and a transverse axis a' at the outer coil position. It is further seen that the apex of each winding, that is the winding heads 17, 18 and 19, in each case are drawn out further, position for position. The relation of the axes of the coils is thereby altered from the inner position a/b to the outer position a'/b', that is the relationship decreases in accordance with the expression $$a/b > a'/b'.$$

With this shaping of the winding, intolerable magnetic flux in the area of the winding heads is prevented.

Although we have described our invention by reference to particular illustrative embodiments thereof, many changes and modifications of the invention will become apparent to those skilled in the art without departing from the spirit and scope of the invention. We therefore intend to include within the patent warranted hereon all such changes and modifications as may reasonably and properly be included within the scope of our contribution to the art.

We claim:

1. A high intensity magnetic field drum separator comprising:

a cryostat including a fixed tubular wall of circular cross-sectional shape, a refrigeration tank fixedly mounted within said fixed tubular wall and having a sector-shaped cross-section with an arcuate portion conforming to the shape of and spaced closely to said fixed tubular wall and other portions spaced from and at a greater distance from said fixed tubular wall, and a magnetic system within said tank including an arcuate coil support of weakly magnetizable iron and a plurality of elliptically shaped superconducting coils supported by said coil support adjacent said arcuate portion to define an operating area;

a rotatable magnetic drum about and closely spaced to said fixed tubular wall for carrying magnetic particles which adhere thereto under the influence of said magnetic system;

means for rotating said drum;

charging means for introducing a slurry containing magnetizable particles into the operating area; and particle removal means for removing magnetic particles from said drum which are magnetically removed from said slurry and adhering to said drum.

2. The separator of claim 1, wherein each of said coils has a longitudinal axis parallel to the axis of rotation of said drum, an arcuate transverse axis in the direction of rotation, and a perpendicular axis extending radially of said drum.

3. A high intensity magnetic field drum separator, comprising:

a cryostat including a refrigeration tank having a wall of sector-shaped cross-section including an arcuate portion, said tank including a refrigerant therein and a plurality of superconducting coils adjacent said arcuate portion, and a circular cross-section outer cryostat wall complementary to, about said tank and adjacent said arcuate portion, the space between said tank wall and said outer wall being evacuated;

reservoir means for holding a slurry containing magnetizable particles;

a rotatable magnetizable drum arranged about said cryostat and disposed at least partially in said reservoir means to rotate through the slurry and magnetically attract the magnetizable particles;

drive means connected to drive said drum through the magnetic field of said coils and through the slurry to attract magnetizable particles; and removal means for removing the magnetizable particles which adhere to said drum.

4. A high intensity magnetic field drum separator, comprising:

a rotatable magnetic drum;

a magnetic system mounted stationary within said rotatable drum and including an arrangement of superconducting conductors, a coil support of weakly magnetizable iron shaped to match and supported adjacent to the curved inner surface of said drum, and a plurality of superconducting coils formed by said conductors embedded in the surface of said support which faces the inner surface of said drum;

a refrigeration tank fixedly mounted within said drum and supporting said magnetic system, said refrigeration tank closely spaced to said drum in the operating area of said magnetic system and greatly spaced from said drum outside of the operating area, said drum having a circular cross-sectional shape and said refrigeration tank having a cross-sectional shape corresponding to a sector of the circular cross-sectional shape of said drum; and a cryostat mounted within said drum and including said refrigeration tank and a wall of circular cross-sectional shape within said drum housing and said refrigeration tank.

5. A high intensity magnetic field drum separator, comprising:

a rotatable magnetic drum; and a magnetic system mounted stationary within said rotatable drum and including an arrangement of superconducting conductors, a coil support of weakly magnetizable iron shaped to match and supported adjacent to the curved inner surface of said drum, and a plurality of superconducting coils formed by said conductors embedded in the surface of said support which faces the inner surface of said drum, said coils being wound and mounted such that their winding axes extend radially with respect to said drum and said coils being curved in the direction of their transverse axes to conform to the shape of the inner surface of said drum, said coils being mounted and connected to be energized in the same direction.

6. The separator of claim 5, wherein each of said coils has a plurality of generally elliptical windings which are progressively larger such that the relationship $$a/b > a'/b'$$

where $a$ = transverse axis of the innermost winding, $a'$ = transverse axis of the outermost winding, $b$ = longitudinal axis of the innermost winding, and $b'$ = longitudinal axis of the outermost winding.

* * * * *